US008965251B2

(12) United States Patent
Mitsui et al.

(10) Patent No.: US 8,965,251 B2
(45) Date of Patent: Feb. 24, 2015

(54) POWDER CONTAINER AND IMAGE FORMING APPARATUS

(71) Applicant: Fuji Xerox Co., Ltd, Minato-ku, Tokyo (JP)

(72) Inventors: Taro Mitsui, Kanagawa (JP); Akihiro Ouchi, Kanagawa (JP); Koichi Sato, Kanagawa (JP); Yusuke Sakai, Kanagawa (JP); Hirohisa Hoshino, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 84 days.

(21) Appl. No.: 13/893,660

(22) Filed: May 14, 2013

(65) Prior Publication Data

US 2014/0133890 A1 May 15, 2014

(30) Foreign Application Priority Data

Nov. 9, 2012 (JP) ..... 2012-247311

(51) Int. Cl.
*G03G 15/08* (2006.01)

(52) U.S. Cl.
CPC ..... *G03G 15/0865* (2013.01); *G03G 15/0875* (2013.01); *G03G 2215/0802* (2013.01)
USPC ..... 399/263; 399/262

(58) Field of Classification Search
CPC ..... G03G 15/0832; G03G 21/105
USPC ..... 399/262, 263
See application file for complete search history.

(56) References Cited

U.S. PATENT DOCUMENTS

2012/0014728 A1* 1/2012 Karasawa et al. ..... 399/360

FOREIGN PATENT DOCUMENTS

JP 2006-133397 A 5/2006
JP 2006133397 A * 5/2006

OTHER PUBLICATIONS

Onuki et al. English Machine Translation of JP 2006-133397. Published May 2006. Translated Sep. 29, 2014.*

* cited by examiner

*Primary Examiner* — Ryan Walsh
*Assistant Examiner* — Philip Marcus T Fadul
(74) *Attorney, Agent, or Firm* — Sughrue Mion, PLLC

(57) ABSTRACT

A powder container includes a container body for storing powder, the container body having an introduction port from which the powder is introduced; a transport member having one end provided, in a rotatable manner, on a side wall of the container body, at a position below the introduction port, and the other end serving as a free end that is displaced upward as the amount of powder recovered in the container body increases, the transport member transporting the powder from the one end to the other end by being rotated; and guide portions provided on the container body to guide the transport member in directions intersecting a direction in which the other end of the transport member is displaced as the transport member is displaced upward.

6 Claims, 9 Drawing Sheets

POWDER CONTAINER AND IMAGE FORMING APPARATUS

CROSS-REFERENCE TO RELATED APPLICATIONS

This application is based on and claims priority under 35 USC 119 from Japanese Patent Application No. 2012-247311 filed Nov. 9, 2012.

BACKGROUND

Technical Field

The present invention relates to a powder container and an image forming apparatus.

SUMMARY

According to an aspect of the invention, there is provided a powder container including a container body for storing powder, the container body having an introduction port from which the powder is introduced; a transport member having one end provided, in a rotatable manner, on a side wall of the container body, at a position below the introduction port, and the other end serving as a free end that is displaced upward as the amount of powder recovered in the container body increases, the transport member transporting the powder from the one end to the other end by being rotated; and guide portions provided on the container body to guide the transport member in directions intersecting a direction in which the other end of the transport member is displaced as the transport member is displaced upward.

BRIEF DESCRIPTION OF THE DRAWINGS

Exemplary embodiments of the present invention will be described in detail based on the following figures, wherein.

DETAILED DESCRIPTION

First Exemplary Embodiment

An example of a powder container and an image forming apparatus according to a first exemplary embodiment of the present invention will be described.

Overall Configuration

Figure 1:
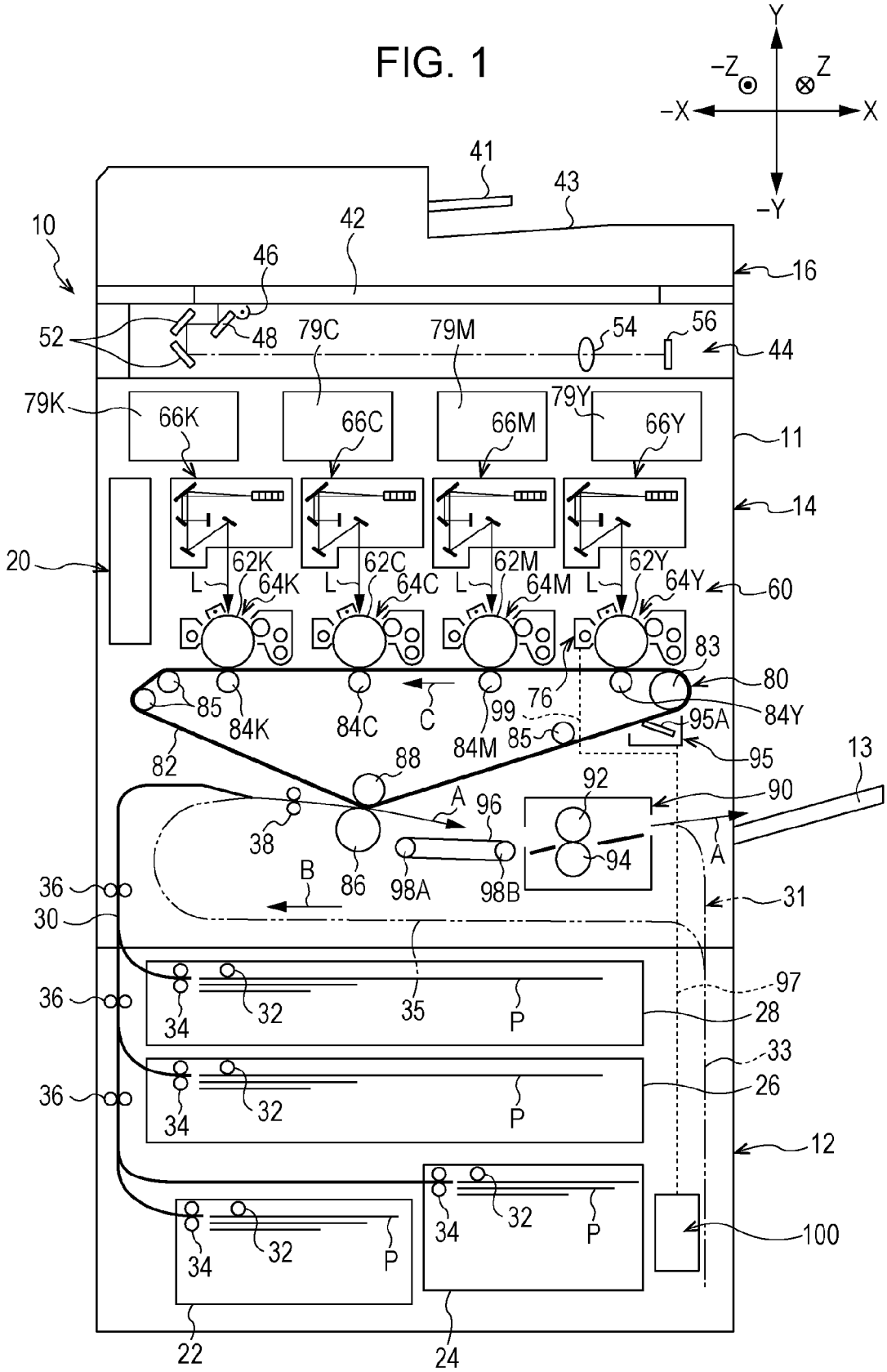
FIG. 1 illustrates the overall configuration of an image forming apparatus according to a first exemplary embodiment.

FIG. 1 illustrates an image forming apparatus 10, which is an example of the first exemplary embodiment. The image forming apparatus 10 has a sheet container 12, a principal operating unit 14, and a document reading unit 16, from the lower side to the upper side in a top-bottom direction (Y direction). The principal operating unit 14 has a controller 20 that controls the operation of the respective sections of the image forming apparatus 10.

In the drawings, a symbol formed of a circle (○) and a cross (×) inside the circle represents an arrow pointing from the near side to the far side, and a symbol formed of a circle (○) and a dot (•) inside the circle represents an arrow pointing from the far side to the near side. Furthermore, when the image forming apparatus 10 is viewed from a user (not illustrated) (i.e., in the front view), the right, left, upper, lower, far, and near sides correspond to X, −X, Y, −Y, Z, and −Z directions, respectively.

The sheet container 12 includes a first container 22, a second container 24, a third container 26, and a fourth container 28 stores recording paper P having different sizes, which are an example of a recording medium. The first container 22, the second container 24, the third container 26, and the fourth container 28 are each provided with a feed roller 32 for feeding the recording paper P stored therein one-by-one and transport rollers 34 for transporting the recording paper P fed by the feed roller 32 to a transport path 30 provided in the image forming apparatus 10.

Furthermore, transport rollers 36 for transporting the recording paper P one-by-one are provided in the transport path 30, on the downstream side of the transport rollers 34. Furthermore, positioning rollers 38 that temporarily stop the recording paper P and feed the recording paper P at a predetermined timing to a second transfer position (described below), thereby performing image transfer positioning, are provided in the transport path 30 inside the principal operating unit 14, on the downstream side of the transport rollers 36 in the transportation direction of the recording paper P.

In the front view of the image forming apparatus 10, the upstream portion of the transport path 30 extends straight in the Y direction from the −X direction side of the sheet container 12 to the −X direction side of the principal operating unit 14. Furthermore, the downstream portion of the transport path 30 extends from the lower part of the −X direction side of the principal operating unit 14 to a sheet-output portion 13 provided on a side surface, on the X direction side, of the principal operating unit 14. Furthermore, a duplex transport path 31, in which the recording paper P is transported and reversed when images are to be formed on both sides of the recording paper P, is connected to the transport path 30. An arrow A indicates the transportation direction of the recording paper P when duplex transportation is not performed.

In the front view of the image forming apparatus 10, the duplex transport path 31 has a reversing portion 33 extending straight in the Y direction from the lower part of the X direction side of the principal operating unit 14 to the X direction side of the sheet container 12 and a transport portion 35 that transports the recording paper P in the −X direction (indicated by an arrow B). The downstream end of the transport portion 35 is connected to the transport path 30, via a guide member (not illustrated), on the upstream side of the positioning rollers 38.

The recording paper P transported to the reversing portion 33 enters the transport portion 35 from the trailing end and is transported in the −X direction (indicated by the arrow B). FIG. 1 does not illustrate transport rollers provided at intervals in the reversing portion 33 and the transport portion 35. A switching member that switches between the transport path 30 and the duplex transport path 31 and a back-feed prevention member that prevents the recording paper P from being transported in the opposite direction from the reversing portion 33 to the transport path 30 are not illustrated either.

Furthermore, a waste-toner container 100, which is an example of a powder container and a toner container and will be described in detail below, is removably attached to a portion between the second container 24 of the sheet container 12 and the reversing portion 33. Note that the waste-toner container 100 is attached to an apparatus body 11 by pushing it in the Z direction and is removed from the apparatus body 11 by pulling it in the −Z direction.

The document reading unit 16 includes a document tray 41 on which documents (not illustrated) are placed, a platen glass 42 on which one document is placed, a document reading device 44 that reads the document on the platen glass 42, and a document output portion 43 onto which the document after reading is output.

The document reading device 44 includes a light irradiating portion 46, one full-rate mirror 48, two half-rate mirrors 52, an imaging lens 54, and a photoelectric converter 56. The light irradiating portion 46 irradiates the document placed on the platen glass 42 with light. The full-rate mirror 48 and the half-rate mirrors 52 reflect light radiated by the light irradiating portion 46 and reflected from the document in the direction parallel to the platen glass 42.

The imaging lens 54 is disposed so as to receive the light reflected by the full-rate mirror 48 and the half-rate mirrors 52. The photoelectric converter 56 converts the reflected light, which is imaged by the imaging lens 54, into an electrical signal. The electrical signal converted by the photoelectric converter 56 is processed by an image processing device (not illustrated) and is used to form an image. The full-rate mirror 48 travels along the platen glass 42 at full rate, and the half-rate mirrors 52 travel along the platen glass 42 at half rate. The imaging lens 54 and the photoelectric converter 56 are stationary.

The principal operating unit 14 is disposed inside the apparatus body 11, which includes several frames, and includes an image forming unit 60, which is an example of an image forming unit, that forms a toner image (developer image) on the recording paper P, and a fixing device 90 that fixes the toner image on the recording paper P formed by the image forming unit 60.

The image forming unit 60 includes image forming units 64Y, 64M, 64C, and 64K and exposure units 66Y, 66M, 66C, and 66K, which correspond to yellow (Y), magenta (M), cyan C, and black (K) toners, and a transfer unit 80. The image forming unit 64Y, 64M, 64C, and 64K have photosensitive members 62Y, 62M, 62C, and 62K, respectively, which are an example of an image bearing member. In the description below, Y, M, C, or K will be affixed to reference numbers when distinction is needed, whereas Y, M, C, or K will be omitted when the configurations are the same and need not be distinguished.

The exposure unit 66 scans a laser beam emitted from a light source (not illustrated) with a rotating polygonal mirror (no reference numeral is given) and reflects the laser beam with several optical components (not illustrated) including a reflecting mirror, thereby emitting a laser beam L, corresponding to each toner, to the photosensitive member 62. The photosensitive member 62 is disposed below (on the −Y direction side of) the exposure unit 66.

Figure 2:
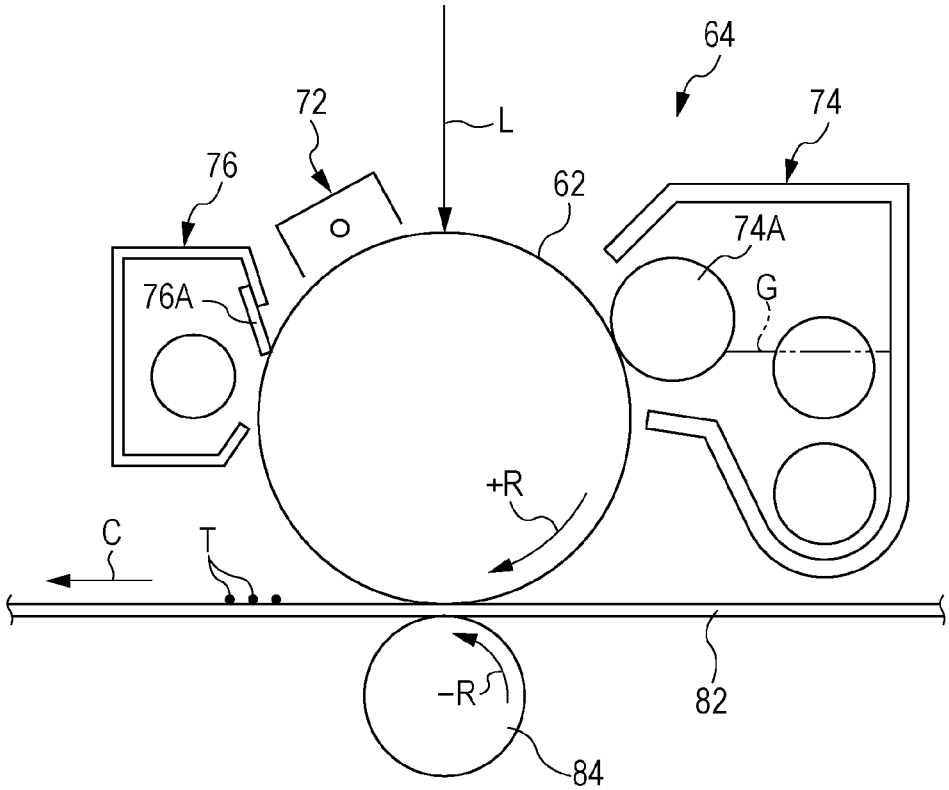
FIG. 2 illustrates the configuration of an image forming unit according to the first exemplary embodiment.

As illustrated in FIG. 2, the image forming unit 64 includes the photosensitive member 62; and a charger 72, a developing unit 74, and a first cleaning unit 76, which is an example of a collecting unit, arranged in this order from the upstream side to the downstream side in the rotation direction so as to face the outer circumference of the photosensitive member 62. Note that the charger 72 and the developing unit 74 are arranged such that a portion between the charger 72 and the developing unit 74 on the outer circumference of the photosensitive member 62 is irradiated with the laser beam L. Furthermore, an intermediate transfer belt 82 (described below) is in contact with a portion between the developing unit 74 and the cleaning unit 76 on the outer circumference of the photosensitive member 62.

The photosensitive member 62 includes a cylindrical conductive base member (not illustrated) that is composed of aluminum or the like and is grounded; and a surface layer (not illustrated) including a charge generating layer, a charge transport layer, and a protection layer, which are radially layered on the outer circumference of the base member. The photosensitive member 62 is rotated by a motor (not illustrated) in an arrow +R direction (clockwise in FIG. 2).

The charger 72 includes, for example, a corotron-type charger that applies a voltage to a wire to charge, utilizing corona discharge, the outer circumference of the photosensitive member 62 with a voltage having the same polarity as the toner. When the charged outer circumference of the photosensitive member 62 is irradiated with the laser beam L in accordance with image data, a latent image (electrostatic latent image) is formed thereon.

The developing unit 74 accommodates developer G, which is, for example, a mixture of carrier particles composed of a magnetic material and toner T, which is an example of powder. The developing unit 74 has a cylindrical developing sleeve 74A that accommodates a magnet roller (not illustrated) having more than one magnetic pole in the circumferential direction. Furthermore, when the developing sleeve 74A is rotated, the developing unit 74 forms a magnetic brush at a position where it faces the photosensitive member 62. When a developing bias voltage is applied to the developing sleeve 74A by a voltage applying device (not illustrated), the developing unit 74 visualizes the latent image on the outer circumference of the photosensitive member 62 with the toner, thereby forming a toner image (developer image).

The toner T is supplied to each developing unit 74 from a corresponding toner cartridge 79 (see FIG. 1) provided above the image forming unit 60. When a consumption period set on the basis of, for example, the number of images formed has elapsed, the developer G in each developing unit 74 is recovered in a waste-toner container 100 (see FIG. 1) via a waste-toner transport path 97 described below (see FIG. 1).

The first cleaning unit 76 has a cleaning blade 76A that is disposed such that an end thereof faces the rotation direction of the photosensitive member 62 and that is in contact with the outer circumference of the photosensitive member 62. The first cleaning unit 76 scrapes off and collects (recovers), with the cleaning blade 76A, the toner remaining untransferred on the outer circumference of the photosensitive member 62. The intermediate transfer belt 82, which is an example of an image bearing member, to which the toner image developed by the developing unit 74 is first transferred is provided on the downstream side of the developing unit 74 in the rotation direction of the photosensitive member 62.

As illustrated in FIG. 1, the transfer unit 80 includes the intermediate transfer belt 82, first transfer rollers 84, a second transfer roller 86, and an auxiliary roller 88.

The intermediate transfer belt 82 is a film-like endless belt composed of, for example, polyimide or polyamide containing carbon black (antistatic agent). A driving roller 83 that is disposed near the image forming unit 64Y and the first transfer roller 84Y and is rotated by a motor (not illustrated) and transport rollers 85 are provided on the inner side of the intermediate transfer belt 82. The intermediate transfer belt 82 is wound around the driving roller 83, the transport rollers 85, and the auxiliary roller 88. Thus, when the driving roller 83 is rotated counterclockwise, the intermediate transfer belt 82 runs in the arrow C direction (counterclockwise direction in FIG. 2).

Each first transfer roller 84 is formed of, for example, a cylindrical metal shaft, such as stainless steel, and a rubber foam layer (not illustrated) provided around the shaft and is rotatable because the ends of the shaft are supported by bearings. A voltage having a polarity opposite to that of the toner is applied to the shaft from a power supply (not illustrated), whereby the first transfer roller 84 transfers the toner image from the photosensitive member 62 to the intermediate transfer belt 82 (first transfer).

The second transfer roller 86 has, for example, the same configuration as that of the first transfer rollers 84 and is disposed, in a rotatable manner, on the downstream side of the positioning rollers 38 in the transport path 30. The second transfer roller 86 is in contact with the outer circumference of the intermediate transfer belt 82 such that the intermediate transfer belt 82 is disposed between the transfer roller 86 and the auxiliary roller 88. The second transfer roller 86 is grounded and transfers the toner images sequentially layered on the intermediate transfer belt 82 to the recording paper P (second transfer) by utilizing the potential difference with respect to the auxiliary roller 88 (described below).

The auxiliary roller 88 serves as a counter electrode to the second transfer roller 86. A second transfer voltage is applied to the auxiliary roller 88 through a power-supply metal roller (not illustrated) provided so as to be in contact with the outer circumference of the auxiliary roller 88. Application of the second transfer voltage to the auxiliary roller 88 induces a potential difference between the auxiliary roller 88 and the second transfer roller 86. This potential difference causes the toner image on the intermediate transfer belt 82 to be transferred (second transfer) to the recording paper P transported to a contact portion between the second transfer roller 86 and the intermediate transfer belt 82.

A second cleaning unit 95, which is an example of a collecting unit, that removes and collects the residual toner and paper dust on the intermediate transfer belt 82 after the second transfer is provided near the driving roller 83, so as to face the outer circumference of the intermediate transfer belt 82.

The second cleaning unit 95 has a cleaning blade 95A, one end of which is fixed to the housing and the other end (free end) of which is in contact with the intermediate transfer belt 82. The waste-toner transport path 97, which is provided with a screw member (not illustrated) rotated to transport the toner T to the downstream side, is connected to the second cleaning unit 95 at the upper end thereof and to a waste-toner container 100 at the lower end thereof. Thus, the toner T collected by the second cleaning unit 95 is transported to the waste-toner container 100.

Furthermore, a waste-toner transport path 99, which is provided with a screw member (not illustrated) rotated to transport the toner T to the downstream side, is connected to the first cleaning unit 76 at the upper end thereof and to the upper end of the waste-toner transport path 97 at the lower end thereof. Thus, the toner T collected by the first cleaning unit 76 is transported to the waste-toner container 100 through the waste-toner transport path 99 and the waste-toner transport path 97.

For example, a seal member (not illustrated) that reflects light is fixed to a reference position in a non-transfer region (i.e., a position to which the toner image is not transferred) on the outer circumference of the intermediate transfer belt 82. A position sensor (not illustrated) that irradiates the non-transfer region of the intermediate transfer belt 82 with light and receives light reflected by the seal member to detect the reference position of the intermediate transfer belt 82 is provided at a position where it faces the seal member. Thus, the image forming unit 60 performs image forming operations in the respective sections in accordance with a signal of the reference position obtained by the position sensor.

As illustrated in FIG. 1, a transport belt 96 that transports, to the fixing device 90 (described below), the recording paper P after the second transfer of the toner image is provided on the downstream side of the second transfer roller 86 in the moving direction of the recording paper P. The transport belt 96 is revolved by a support roller 98A, a driving roller 98B, and a driving unit (not illustrated) including a motor and a gear to transport the recording paper P to the fixing device 90.

The fixing device 90 includes, for example, a heating roller 92 that is heated by a halogen lamp (not illustrated), serving as a heat source, and a pressing roller 94 that is urged toward the heating roller 92 such that the recording paper P is pressed between the pressing roller 94 and the heating roller 92. When the recording paper P after the second transfer enters the nip between the heating roller 92 and the pressing roller 94, the fixing device 90 applies heat and pressure thereto to fix the toner image T to the recording paper P.

Image Forming Process

Next, the image forming process performed by the image forming apparatus 10 will be described.

As illustrated in FIG. 1, in the image forming apparatus 10, the outer circumferences of the photosensitive members 62 are charged by the corresponding chargers 72 (see FIG. 2) and exposed to laser beams L emitted from the exposure units 66 in accordance with the image data. As a result, electrostatic latent images are formed on the outer circumferences of the photosensitive members 62.

Then, the electrostatic latent images formed on the outer circumferences of the photosensitive members 62 are developed as yellow (Y), magenta (M), cyan C, and black (K) toner images by the corresponding developing units 74 (see FIG. 2).

The toner images formed on the surfaces of the photosensitive members 62 are sequentially transferred, in an overlapping manner, to the intermediate transfer belt 82 by the corresponding first transfer rollers 84. The toner image transferred to the intermediate transfer belt 82 is then transferred (second transfer) to the recording paper P, transported along the transport path 30, by the auxiliary roller 88 and the second transfer roller 86.

The recording paper P to which the toner image has been transferred is then transported to the fixing device 90 by the transport belt 96. The fixing device 90 applies heat and pressure to the toner image on the recording paper P to fix the toner image. The recording paper P to which the toner image has been fixed is discharged to, for example, the sheet-output portion 13. In this way, the image forming process is performed. When a toner image is to be formed on a non-image surface where an image is not yet formed (i.e., when duplex image forming is performed), after an image is fixed to the surface by the fixing device 90, the recording paper P is fed to the duplex transport path 31 so that an image is formed and fixed on the rear surface thereof.

Configuration of Relevant Part

An example of the waste-toner container 100 will be described.

Figure 3A:
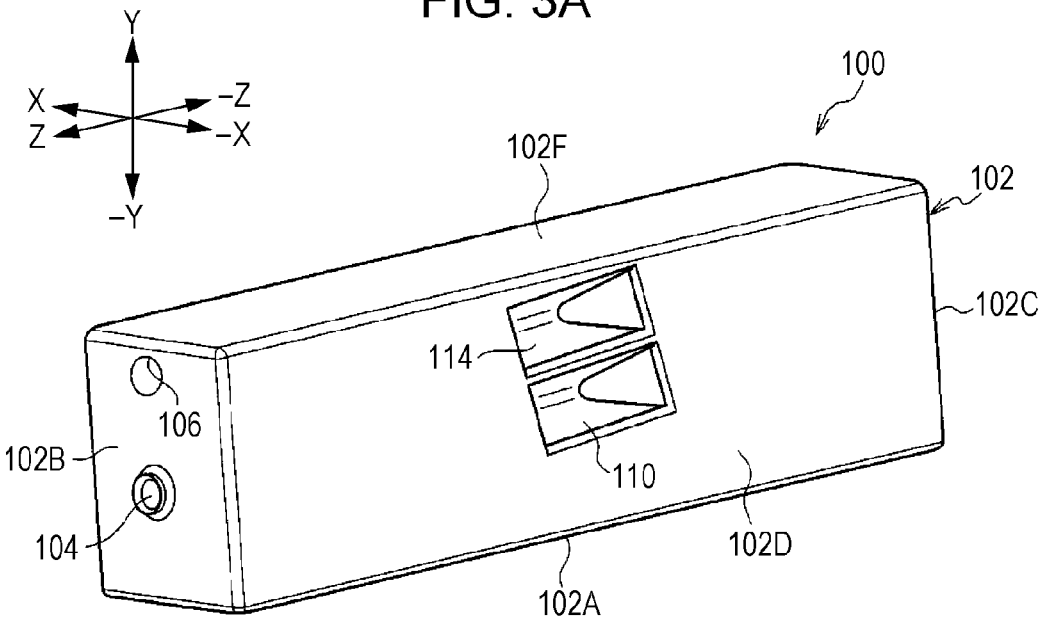
FIGS. 3A and 3B are perspective views of a waste-toner container according to the first exemplary embodiment.
Figure 3B:
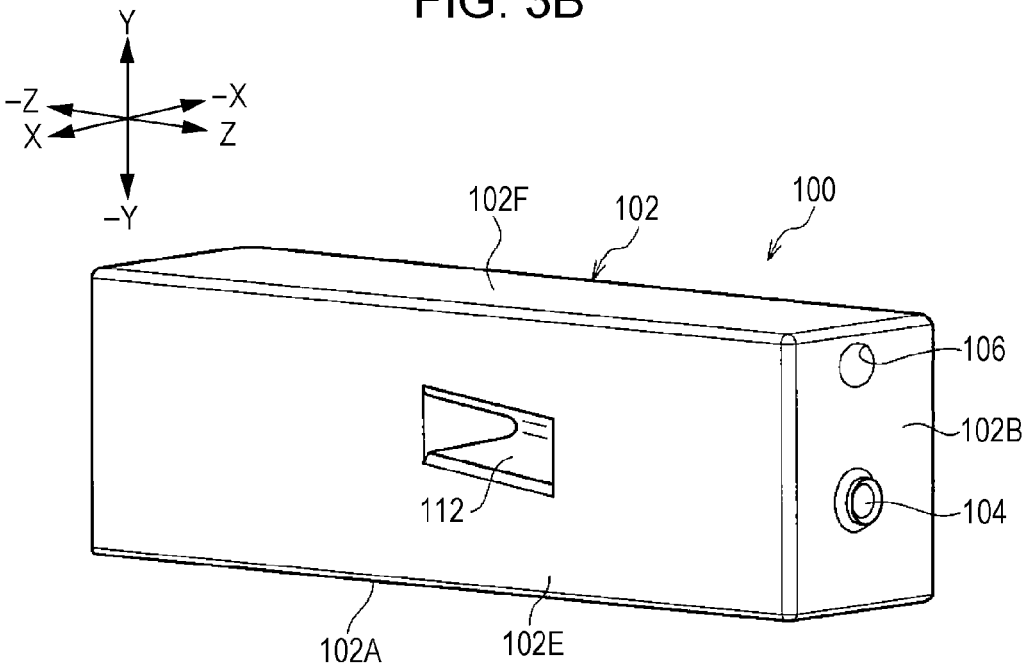

As illustrated in FIGS. 3A and 3B, the waste-toner container 100 has a hollow, rectangular-parallelepiped container body 102 having an internal space for storing waste toner.

The container body 102 has a bottom wall 102A; a far wall 102B, a near wall 102C, a left wall 102D, and a right wall 102E standing upright from the edges of the bottom wall 102A; and an upper wall 102F. The far wall 102B is disposed parallel to the X-Y plane on the Z direction side (far side) when attached to the apparatus body 11 (see FIG. 1). The near wall 102C is disposed parallel to the X-Y plane on the −Z direction side (near side) when attached to the apparatus body 11 (see FIG. 1).

The left wall 102D is disposed parallel to the Y-Z plane on the −X direction side when attached to the apparatus body 11. The right wall 102E is disposed parallel to the Y-Z plane on the X direction side when attached to the apparatus body 11. The far wall 102B is an example of a side wall, and the left wall 102D and the right wall 102E are an example of a wall portion disposed in a direction intersecting the far wall 102B.

A coupling portion 104 that causes a transport screw 116 (see FIG. 4A, described below) to rotate is provided on the far wall 102B, at the center in the X direction (width direction) and slightly below the center in the Y direction. Furthermore, an insertion hole 106 into which a transport pipe 120 (see FIG. 5A) provided on the apparatus body 11 (see FIG. 1) is inserted is provided in the far wall 102B, above the coupling portion 104 in the Y direction.

Figure 5A:
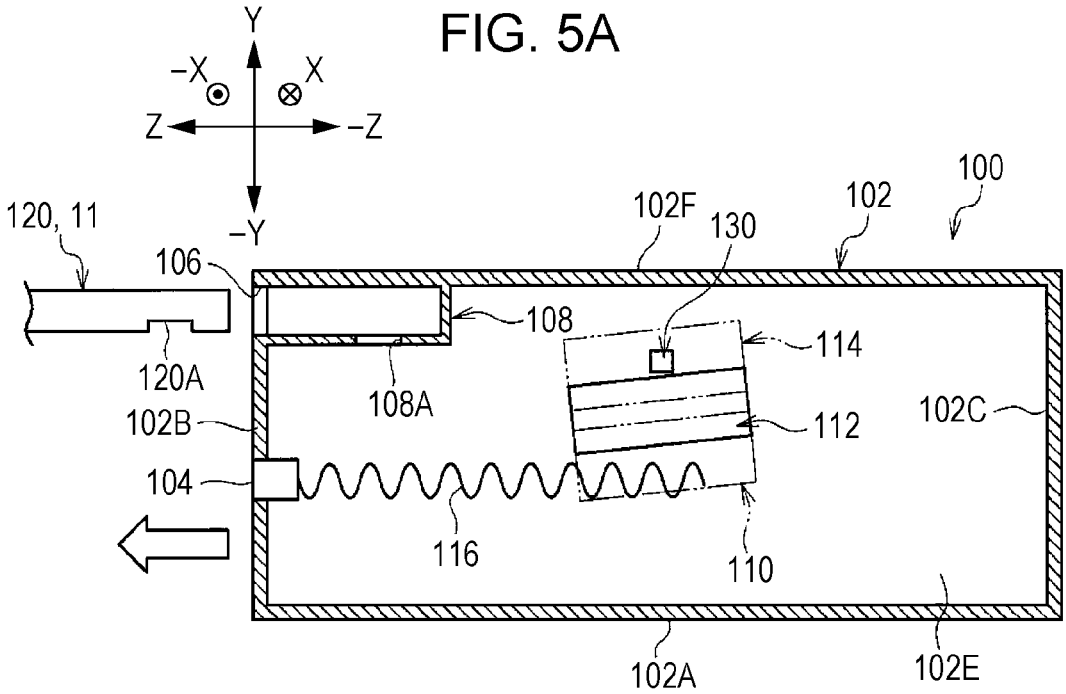
FIGS. 5A and 5B illustrate attachment of the waste-toner container to the image forming apparatus according to the first exemplary embodiment.
Figure 5B:
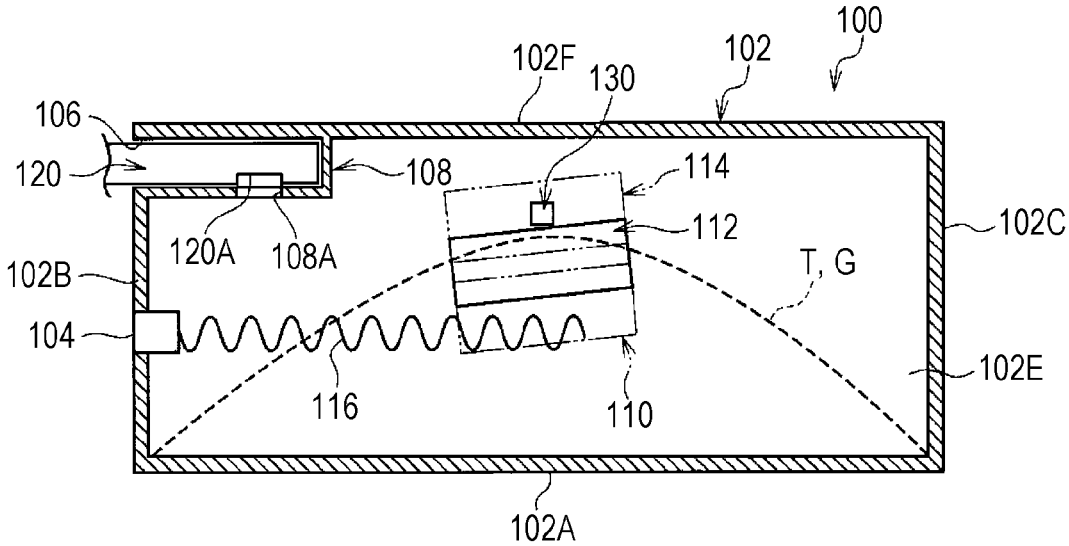

The transport pipe 120 is provided at the downstream end of the waste-toner transport path 97 (see FIG. 1) in the apparatus body 11 and, as illustrated in FIGS. 5A and 5B, extends in the −Z direction from a portion of the apparatus body 11 on the Z direction side. The transport pipe 120 has, at the −Z direction end thereof, a toner discharge port 120A opening in the −Y direction.

Furthermore, the transport pipe 120 accommodates, in a rotatable manner, a waste-toner transporting member (not illustrated) that has a rotation shaft and a spiral blade provided around the rotation shaft. The waste toner transported by the waste-toner transporting member is discharged from the toner discharge port 120A. The transport pipe 120 also has a shutter member (not illustrated) that opens or closes the toner discharge port 120A upon attachment or removal of the waste-toner container 100.

The far wall 102B has a toner introduction portion 108 projecting in the −Z direction, at the center in the X direction and the upper end in the Y direction. The toner introduction portion 108 has, for example, a cylindrical shape. The inside diameter of the toner introduction portion 108 is set such that the transport pipe 120 is inserted therein while making contact therewith. The length of the toner introduction portion 108 in the Z direction is, for example, about one-fourth of that of the waste-toner container 100.

Furthermore, the toner introduction portion 108 has, in the bottom portion thereof (on the −Y direction side), an introduction port 108A from which the waste toner discharged from the toner discharge port 120A in the transport pipe 120 is introduced. The toner introduction portion 108 also has a shutter member (not illustrated) that is urged in the Z direction by an urging member, such as a spring, and opens or closes when the transport pipe 120 is inserted or retracted. With this configuration, when the transport pipe 120 is inserted into the toner introduction portion 108, the toner discharge port 120A and the introduction port 108A overlap in the Y direction, allowing the waste toner to be introduced from the transport pipe 120 to the waste-toner container 100.

The coupling portion 104 illustrated in FIGS. 3A and 3B is engageable with a receiving portion (not illustrated) that is provided on the apparatus body 11 and is rotated by a driving unit (not illustrated) including a motor. When the waste-toner container 100 is attached to the apparatus body 11, the coupling portion 104 engages with the receiving portion and is rotated by the driving unit.

Figure 4A:
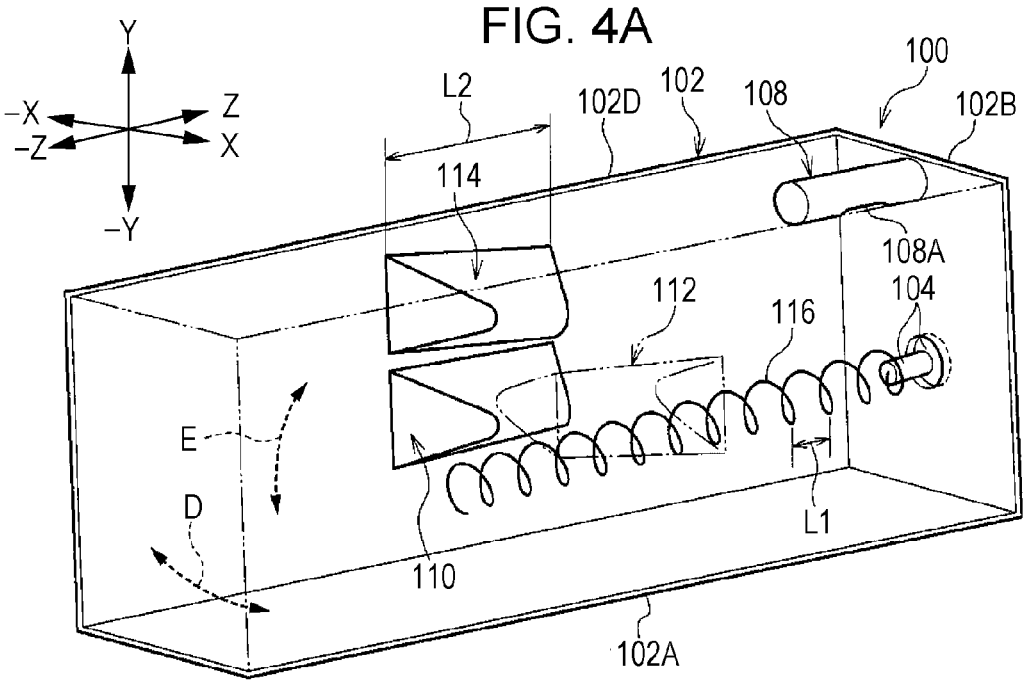
FIG. 4A illustrates the internal configuration of the waste-toner container according to the first exemplary embodiment.

As illustrated in FIG. 4A, the coupling portion 104 projects in the −Z direction, into the waste-toner container 100, from the far wall 102B. One end (Z direction end) of the transport screw 116, which is an example of the transport member, is attached to the coupling portion 104.

The transport screw 116 is, for example, a spiral member made of stainless steel, and the other end (−Z direction end) is a free end. That is, the transport screw 116 is supported, in a rotatable manner, at one end by the far wall 102B, at a position below the introduction port 108A in the container body 102, and is rotated in accordance with the rotation of the coupling portion 104.

The coupling portion 104 supports the transport screw 116 so as to allow the other end of the transport screw 116 to be displaced in arch shapes centered at the coupling portion 104 (i.e., arrow D and arrow E directions in FIG. 4A) in the X-Y plane. That is, the transport screw 116 is rotated around axes extending in directions intersecting a rotation shaft (not illustrated) extending in the Z direction through the rotation axis of the coupling portion 104.

Furthermore, the length of the transport screw 116 is, for example, slightly larger than half the length of the container body 102 in the Z direction, and the transport screw 116 extends in the −Z direction from the far wall 102B up to the center of the container body 102. The pitch of the spiral of the transport screw 116 in the Z direction is L1 (see FIG. 4A). When the transport screw 116 and the far wall 102B are located on the Z direction side, the width of the far wall 102B in the X direction is, for example, about seven times the outside diameter of the transport screw 116.

When the coupling portion 104 is rotated, the transport screw 116 transports the waste toner from one end (the Z direction end) to the other end (the −Z direction end). As has been described above, because the transport screw 116 is supported by the coupling portion 104 at one end, the other end is displaced upward, in the Y direction, as the amount of waste toner recovered in the container body 102 increases (see FIG. 4B).

As illustrated in FIGS. 3A and 3B, the left wall 102D has, for example, a first guide 110 and a third guide 114 provided by recessing portions of the left wall 102D in the X direction. The right wall 102E has a second guide 112 provided by recessing a portion of the right wall 102E in the −X direction. The first guide 110, the second guide 112, and the third guide 114 are an example of a guide portion.

The first guide 110 is provided in the left wall 102D, almost at the center in the Z direction and almost at the center in the Y direction, and the third guide 114 is provided above the first guide 110 in the Y direction. The second guide 112 is provided in the right wall 102E, at the center in the Z direction and at the center in the Y direction. The recesses of the first guide 110, the second guide 112, and the third guide 114 are large enough to receive fingers of a user.

Figure 4B:
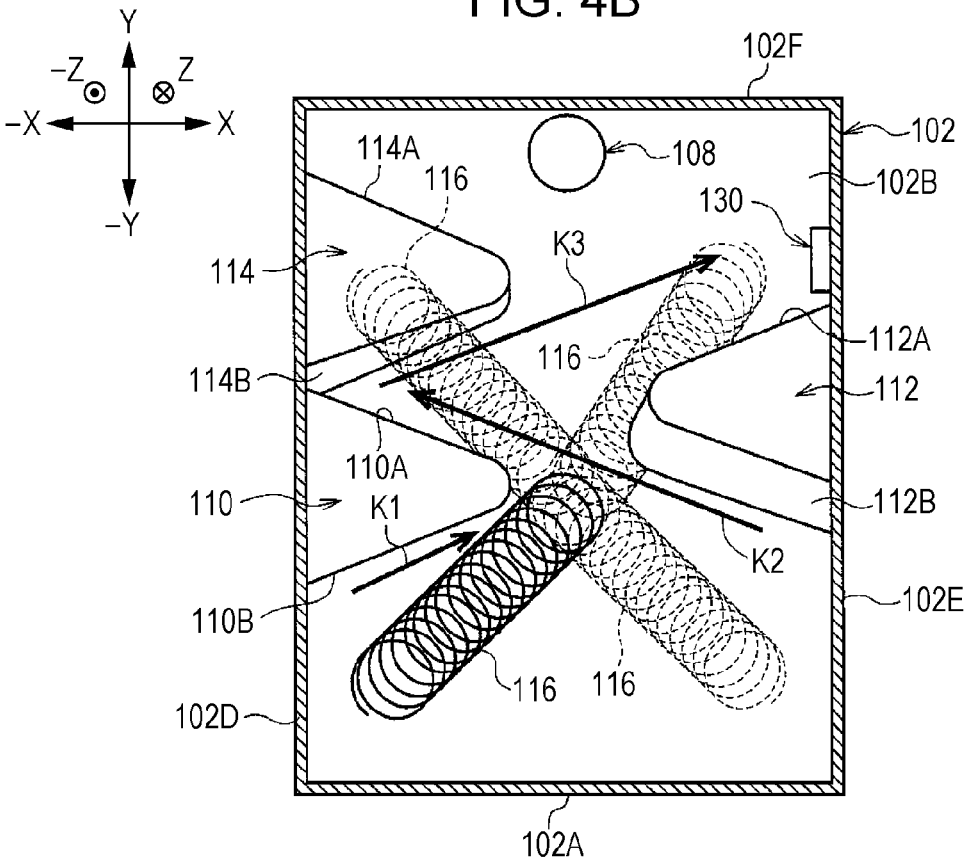
FIG. 4B illustrates the movement of a free end of a transport screw according to the first exemplary embodiment.

More specifically, as illustrated in FIG. 4B, the first guide 110 has an almost triangular shape in the X-Y section, and the top (apex) projecting in the X direction is rounded. The top surface of the first guide 110 is an inclined surface 110A that is higher on the −X direction side than on the X direction side, and the lower surface of the first guide 110 is an inclined surface 110B that is higher on the X direction side than on the −X direction side. The inclined surfaces 110A and 110B are, for example, inclined such that the Z direction side is lower than the −Z direction side.

The second guide 112 has an almost triangular shape in the X-Y section, and the top (apex) projecting in the −X direction is rounded. The top surface of the second guide 112 is an inclined surface 112A that is higher on the X direction side than on the −X direction side, and the lower surface of the second guide 112 is an inclined surface 112B that is higher on the −X direction side than on the X direction side. The inclined surfaces 112A and 112B are, for example, inclined such that the Z direction side is lower than the −Z direction side.

The third guide 114 has an almost triangular shape in the X-Y section, and the top (apex) projecting in the X direction is rounded. The top surface of the third guide 114 is an inclined surface 114A that is higher on the −X direction side than on the X direction side, and the lower surface of the third guide 114 is an inclined surface 114B that is higher on the X direction side than on the −X direction side. The inclined surfaces 114A and 114B are, for example, inclined such that the Z direction side is lower than the −Z direction side.

The inclined surfaces 110B, 112B, and 114B serve as guide surfaces that guide the transport screw 116, which is moved upward as the toner T accumulates, in directions intersecting the Y-Y direction (top-bottom direction). More specifically, the inclined surface 110B guides the transport screw 116 in an arrow K1 direction, the inclined surface 112B guides the transport screw 116 in an arrow K2 direction, and the inclined surface 114B guides the transport screw 116 in an arrow K3 direction.

The arrows K1 and K3 are inclined in the X direction with respect to the Y direction, and the arrow K2 is inclined in the −X direction with respect to the Y direction. The inclined surfaces 110B, 112B, and 114B partially overlap one another as viewed from the X direction, and, because the height positions thereof (i.e., the positions thereof in the Y direction) are set in the above-described order, the transport screw 116 is sequentially guided along the arrows K1, K2, and K3.

On the other hand, depending on the state of the accumulated waste toner (toner T) in the container body 102, the inclined surfaces 110A, 112A, and 114A serve as support surfaces that support the transport screw 116.

As illustrated in FIG. 4A, the size of the third guide 114 in the Z direction (i.e., the length of the third guide 114), L2, is larger than the pitch, L1, of the spiral of the transport screw 116. The sizes of the first guide 110 and second guide 112 in the Z direction are also L2, which are not illustrated.

As illustrated in FIG. 4B, a full-state detection sensor 130, which is an example of a detecting device, is provided on the right wall 102E of the container body 102, to which the transport screw 116 is guided by the third guide 114, which is located at the highest position in the Y direction.

The full-state detection sensor 130 is, for example, a magnetic permeability sensor that detects the level of the waste toner by using the magnetic properties of the carrier contained in the waste toner. The full-state detection sensor 130 detects the level of the waste toner (and the carrier) in the container body 102. Another example of the full-state detection sensor 130 is an optical sensor that has a light emitting portion and a light receiving portion arranged face-to-face and detects the state of the accumulated waste toner on the basis of the level of lowering of the intensity of light received by the light receiving portion.

As illustrated in FIG. 5A, the full-state detection sensor 130 is provided on the right wall 102E, at the center in the Z direction and on the upper side in the Y direction. For example, the full-state detection sensor 130 and the other end (−Z direction end) of the transport screw 116 are located at substantially the same positions in the Z direction. FIG. 5B illustrates, with a dashed line T (G), the position of the upper surface of the accumulated waste toner T (or the developer G).

COMPARATIVE EXAMPLE

Now, a waste-toner container 200 according to a comparative example will be described. Note that components and portions that are basically the same as those of the waste-toner container 100 according to the first exemplary embodiment will be denoted by the same reference numerals as those used in the first exemplary embodiment, and the description thereof will be omitted.

Figure 9A:
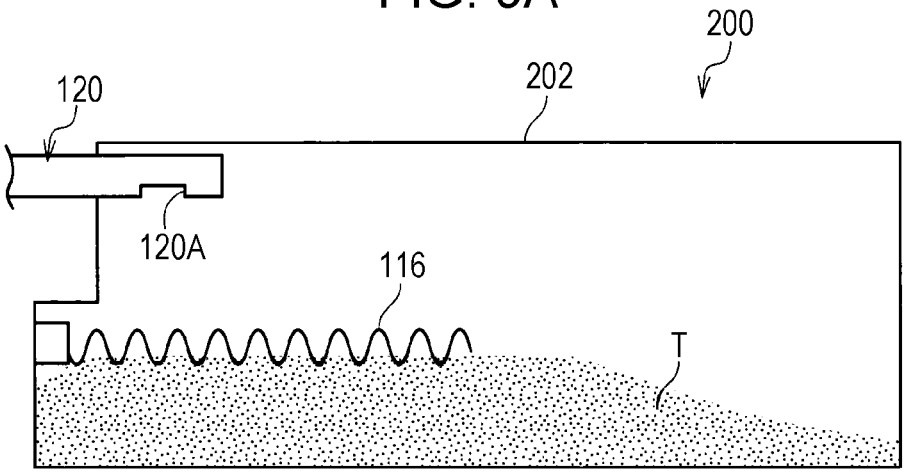
FIG. 9A illustrates the configuration of a waste-toner container according to a comparative example, and FIG. 9B schematically illustrates the shape of toner accumulated in the waste-toner container according to the comparative example.

FIG. 9A illustrates the waste-toner container 200 according to the comparative example. The waste-toner container 200 includes a rectangular-parallelepiped container body 202, the transport pipe 120, through which waste toner is discharged into the container body 202, and the transport screw 116, but not guide portions for guiding the transport screw 116.

Figure 9B:
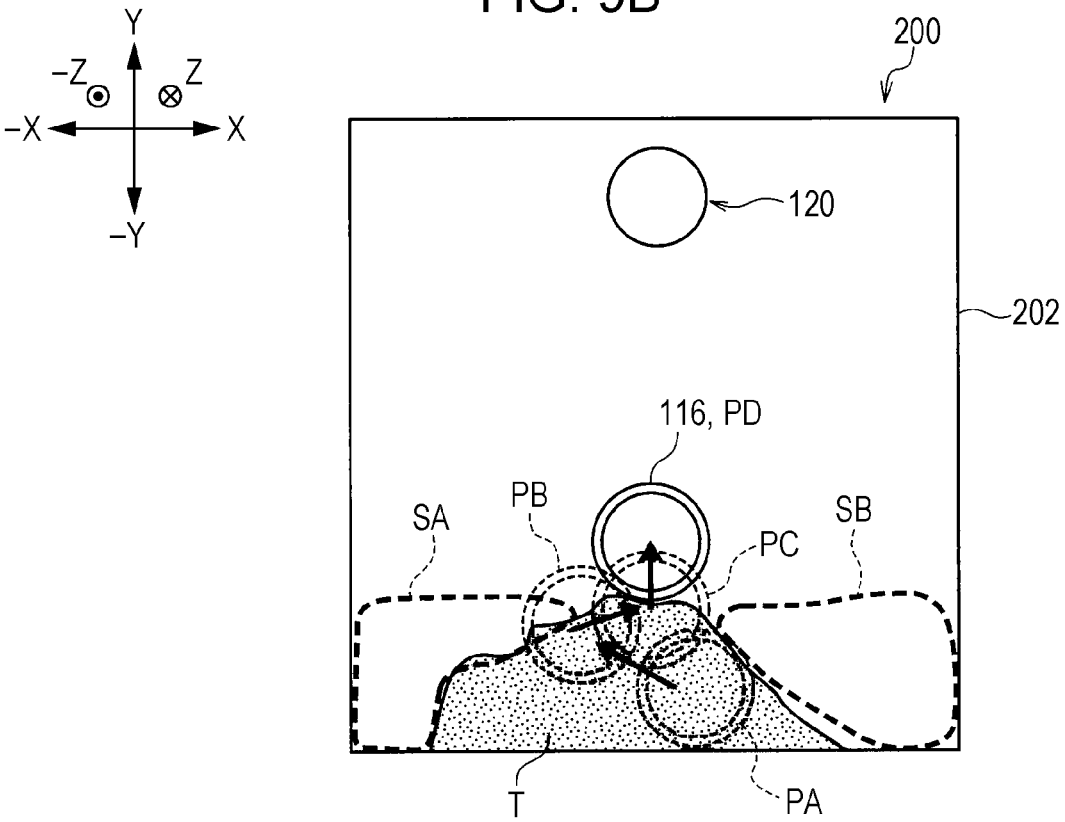

As illustrated in FIG. 9B, when the container body 202 is empty, the transport screw 116 is located at a position indicated by a dashed line PA (on the X direction side with respect to the center). When the waste toner T is recovered in the container body 202, the other end of the transport screw 116 moves sequentially to a position indicated by a dashed line PB (on the −X direction side with respect to the center), to a position indicated by a dashed line PC (substantially the center), and to a position indicated by a dashed line PD (substantially the center and above the dashed line PC), as the amount of recovered waste toner T increases.

Because the waste-toner container 200 according to the comparative example does not have guide portions, the other end of the transport screw 116 moves upward in the Y direction, as the top of the waste toner T accumulated in the container body 202 goes up. As a result, the moving area (moving path) of the transport screw 116 in the X direction is small, and the waste toner T accumulates in a mound with the top being located at the center in the X direction. As a result, empty spaces SA and SB where the waste toner T does not exist are created on the −X direction side and the X direction side of the waste toner T, leading to low filling level of the container body 202 with the waste toner T.

Operation

The operation according to the first exemplary embodiment will be described.

Figure 6A:
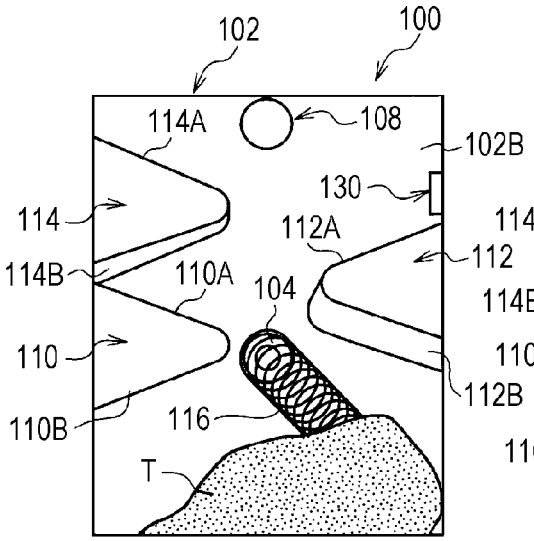
FIGS. 6A to 6D illustrate how the free end of the transport screw is guided by screw guides according to the first exemplary embodiment.
Figure 6B:
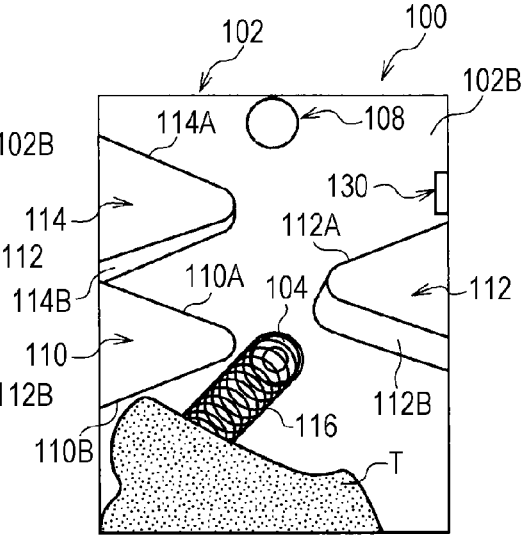

As illustrated in FIG. 6A, when the image forming apparatus 10 (see FIG. 1) performs an image forming operation, waste toner T (containing the carrier) resulting from the image forming operation is introduced into the container body 102 of the waste-toner container 100 from the introduction port 108A (see FIG. 5B). The recovered waste toner T accumulates on the bottom portion of the container body 102 immediately below the introduction port 108A. At this time, the coupling portion 104 is rotated to rotate the transport screw 116 in the container body 102.

At the initial stage of recovering the waste toner T (when the top of the waste toner T is lower than the inclined surface 110B of the first guide 110), a distal end (free end) of the transport screw 116 is bent downward. It is assumed that, for example, the distal end of the transport screw 116 is located below the second guide 112. When a certain amount of waste toner T has accumulated in the container body 102, a portion of the waste toner T at the top is transported to the near side of the container body 102 (in the −Z direction) by the rotating transport screw 116. As a result, the accumulated waste toner T in the container body 102, distributed from the far side to the near side, is evened out. Furthermore, the transport screw 116 is pushed upward as the top (upper surface) of the waste toner T accumulating in the container body 102 goes up.

When the distal end of the transport screw 116 is displaced straight upward, the transport screw 116 comes into contact with the inclined surface 112B of the second guide 112. Because the upward movement of the transport screw 116 is restricted by the inclined surface 112B, the transport screw 116 is guided toward the inclined surface 110A of the first guide 110 (arrow K2) along the inclined surface 112B.

On the other hand, as illustrated in FIG. 6 B, for example, when the mound of the waste toner T is broken, and the distal end of the transport screw 116 is moved below the first guide 110, the distal end of the transport screw 116 is displaced upward and comes into contact with the inclined surface 110B of the first guide 110. Because the upward movement of the transport screw 116 is restricted by the inclined surface 110B, the transport screw 116 is guided toward the inclined surface 112B of the second guide 112 (arrow K1) along the inclined surface 110B. Furthermore, the transport screw 116 that has come into contact with the inclined surface 112B is guided toward the inclined surface 110A of the first guide 110 (arrow K2) along the inclined surface 112B.

Figure 6C:
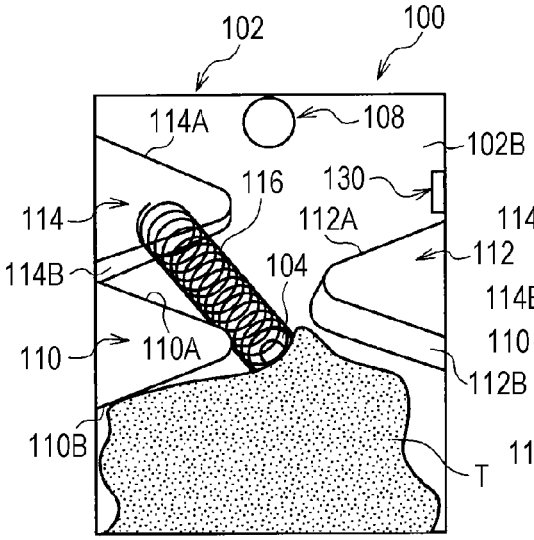

Then, as illustrated in FIG. 6C, the transport screw 116 that has moved over the inclined surface 110A of the first guide 110 is pushed upward by the waste toner T and comes into contact with the inclined surface 114B of the third guide 114.

Figure 6D:
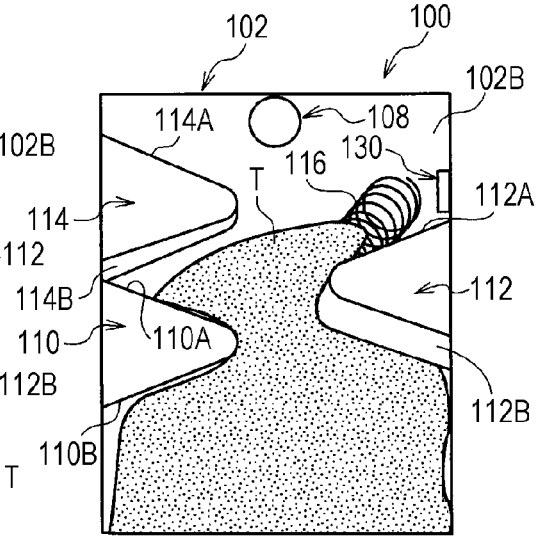

Then, as illustrated in FIG. 6D, because the inclined surface 114B restricts upward movement of the transport screw 116, the transport screw 116 is guided onto the inclined surface 112A of the second guide 112 along the inclined surface 114B.

When the upper surface of the waste toner T recovered and accumulated in the container body 102 reaches the detection height of the full-state detection sensor 130, the full-state detection sensor 130 determines that the waste-toner container 100 is full. Then, on the basis of the information from the full-state detection sensor 130 notifying that the waste-toner container 100 is full, the controller 20 (see FIG. 1) indicates a message suggesting replacement of the waste-toner container 100 on a display panel (not illustrated) of the image forming apparatus 10 (see FIG. 1).

In this manner, in the waste-toner container 100 according to the first exemplary embodiment, the first guide 110, the second guide 112, and the third guide 114 guide the distal end (the other end) of the transport screw 116 in oblique directions intersecting the displacement direction (upward). Because this causes the waste toner T to be transported also in the width direction (the X direction and the −X direction) of the container body 102, the space inside the container body 102 not filled with the waste toner T is reduced compared with the configuration in which guides for the transport screw 116 are not provided.

In the waste-toner container 100, the full-state detection sensor 130 is provided on the right wall 102E, to which the transport screw 116 is eventually guided (by the third guide 114 located at the highest position). Because this configuration enables the full-state detection sensor 130 to detect the height of the upper surface of the waste toner T that has been transported to the side to which the transport screw 116 is guided and that has accumulated to a high filling level, more waste toner T is recovered compared with the case where the full-state detection sensor 130 is provided at another position.

Furthermore, in the waste-toner container 100, the size (length), L2, of the first guide 110, second guide 112, and third guide 114 in the Z direction is larger than the pitch of the spiral, L1, of the transport screw 116. Hence, when the transport screw 116 is rotated, the first guide 110, the second guide 112, or the third guide 114 does not enter the spaces between the spiral blades. Thus, malfunction of the transport screw 116 is prevented.

In addition, in the waste-toner container 100, the first guide 110 and the second guide 112 are provided by recessing portions of the container body 102 inward. This allows a user to place his or her fingers into these recesses to hold the container body 102, without providing separate members for allowing a user to hold the container body 102.

In the image forming apparatus 10, when the full-state detection sensor 130 determines that the waste-toner container 100 is full and the waste-toner container 100 is replaced, the filling level of the waste-toner container 100 with the waste toner is higher than that of the waste-toner container 200 according to the comparative example. Thus, the frequency of replacing the waste-toner container 100 is lower than that of the configuration in which the first guide 110, the second guide 112, or the third guide 114 is not provided.

Second Exemplary Embodiment

Next, an example of a powder container and an image forming apparatus according to a second exemplary embodiment of the present invention will be described.

In the second exemplary embodiment, instead of the waste-toner container 100 (see FIG. 3A) of the above-described image forming apparatus 10 according to the first exemplary embodiment, a waste-toner container 140, which is an example of a powder container and a toner container, is provided. The other configurations are the same as those of the image forming apparatus 10 according to the first exemplary embodiment. Hence, the term "image forming apparatus 10" is used also in the second exemplary embodiment, and components and portions that are basically the same as those of the above-described image forming apparatus 10 according to the first exemplary embodiment will be denoted by the same reference numerals as those used in the first exemplary embodiment, and the description thereof will be omitted.

Figure 7A:
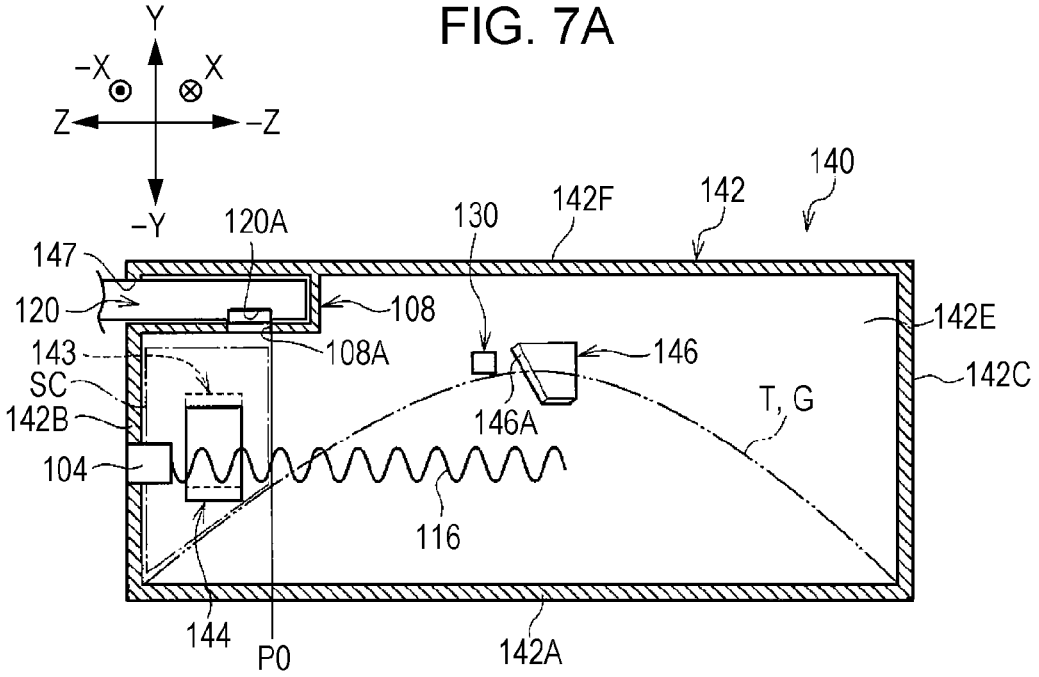
FIG. 7A illustrates the configuration of a waste-toner container according to a second exemplary embodiment.
Figure 7B:
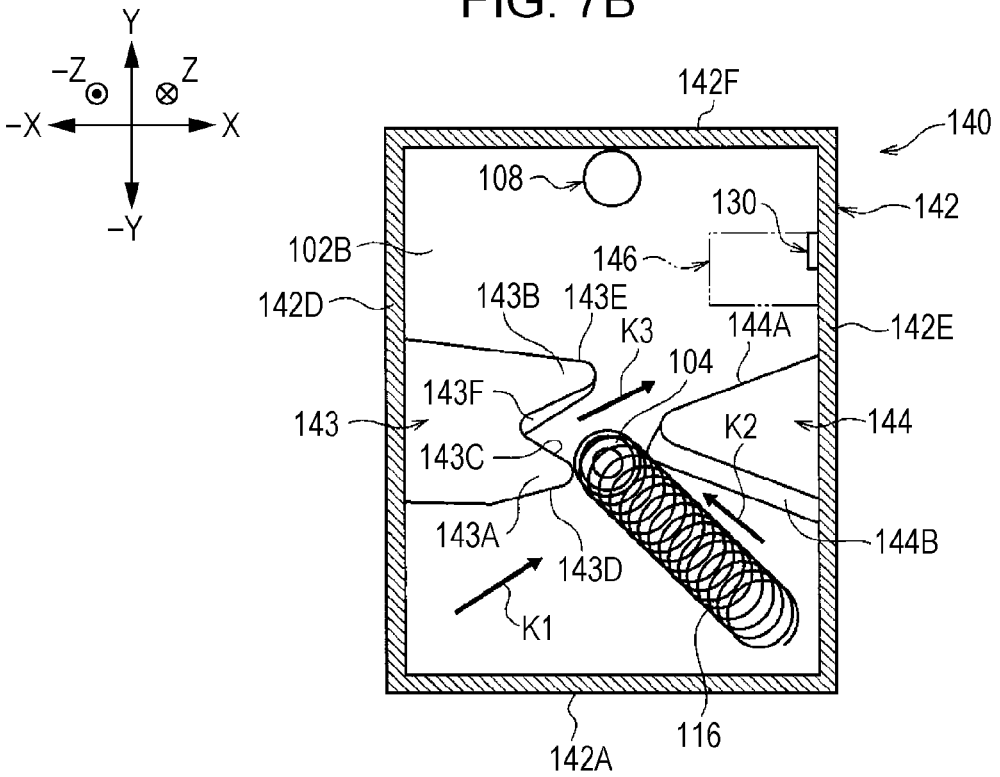
FIG. 7B illustrates how the free end of the transport screw is guided by screw guides according to the second exemplary embodiment.

As illustrated in FIGS. 7A and 7B, the waste-toner container 140 according to the second exemplary embodiment has a hollow, rectangular-parallelepiped container body 142.

The container body 142 has a bottom wall 142A; a far wall 142B, a near wall 142C, a left wall 142D, and a right wall 142E that stand upright from the edges of the bottom wall 142A; and an upper wall 142F. The far wall 142B is disposed parallel to the X-Y plane on the Z direction side (far side) when attached to the apparatus body 11 (see FIG. 1). The near wall 142C is disposed parallel to the X-Y plane on the −Z direction side (near side) when attached to the apparatus body 11 (see FIG. 1).

The left wall 142D is disposed parallel to the Y-Z plane on the −X direction side when attached to the apparatus body 11. The right wall 142E is disposed parallel to the Y-Z plane on the X direction side when attached to the apparatus body 11. The far wall 142B is an example of a side wall, and the left wall 142D and the right wall 142E are an example of a wall portion disposed in a direction intersecting the far wall 142B.

The coupling portion 104 is provided on the far wall 142B, at the center in the X direction (width direction) and slightly below the center in the Y direction. An end, on the Z direction side, of the transport screw 116 is attached to the coupling portion 104. Furthermore, an insertion hole 147 into which the transport pipe 120 is inserted is provided in the far wall 142B, above the coupling portion 104 in the Y direction. When the transport screw 116 and the far wall 142B are disposed on the Z direction, the width of the far wall 142B in the X direction is, for example, about seven times the outside diameter of the transport screw 116.

When the coupling portion 104 is rotated, the transport screw 116 transports the waste toner from one end (the Z direction end) to the other end (the −Z direction end). As has been described above, because the transport screw 116 is supported by the coupling portion 104 at one end, the other end is displaced upward, in the Y direction, as the amount of waste toner recovered in the container body 142 increases.

The left wall 142D has, for example, a first guide 143 that is provided by recessing a portion of the left wall 142D in the X direction. The right wall 142E has a second guide 144 that is provided by recessing a portion of the right wall 142E in the −X direction and a contact portion 146 projecting from the right wall 142E in the −X direction. The first guide 143 and the second guide 144 are an example of a guide portion.

As illustrated in FIG. 7A, when the waste-toner container 140 is disposed on the X direction, the first guide 143 and the second guide 144 are provided in a region SC (indicated by a one-dot chain line) located on the far wall 142B side with respect to the end of the introduction port 108A in the Z direction (position PO). The contact portion 146 is disposed on the right wall 142E, at the center both in the Z direction and the Y direction. The recesses of the first guide 143 and the second guide 144 are large enough to receive fingers of a user.

As illustrated in FIG. 7B, the first guide 143 has two projections extending in the X direction, which are separated from each other in the Y direction and constitute a lower guide portion 143A and an upper guide portion 143B.

The top surface of the lower guide portion 143A is an inclined surface 143C that is higher on the −X direction side than on the X direction side, and the lower surface of the lower guide portion 143A is an inclined surface 143D that is higher on the X direction side than on the −X direction side. The top surface of the guide portion 143B is an inclined surface 143E that is higher on the −X direction side than on the X direction side, and the lower surface of the guide portion 143B is an inclined surface 143F that is higher on the X direction side than on the −X direction side. The inclined surfaces 143D and 143F are, for example, inclined such that the Z direction side is lower than the −Z direction side.

The second guide 144 has an almost triangular shape in the X-Y section, and top (apex) projecting in the −X direction is rounded. The top surface of the second guide 144 is an inclined surface 144A that is higher on the X direction side than on the −X direction side, and the lower surface of the second guide 144 is an inclined surface 144B that is higher on the −X direction side than on the X direction side. The inclined surface 144B is, for example, inclined such that the Z direction side is lower than the −Z direction side.

The inclined surfaces 143D, 143F, and 144B serve as guide surfaces that guide the transport screw 116 in directions intersecting the Y-Y direction (top-bottom direction). More specifically, the inclined surface 143D guides the transport screw 116 in the arrow K1 direction, the inclined surface 144B guides the transport screw 116 in the arrow K2 direction, and the inclined surface 143F guides the transport screw 116 in the arrow K3 direction. The size (length) of the first guide 143, second guide 144, and contact portion 146 in the Z direction is larger than the pitch of the spiral of the transport screw 116.

As illustrated in FIG. 7A, as viewed from the X direction, the contact portion 146 is a projection having a trapezoidal shape with the lower side being shorter than the upper side. The contact portion 146 has, on the Z direction side, an inclined surface 146A that is inclined in the Y direction with respect to the Z direction.

The distance between the center of the coupling portion 104 and the upper end of the inclined surface 146A is larger than the distance between the center of the coupling portion 104 and the lower end of the inclined surface 146A. Furthermore, the distance between the center of the coupling portion 104 and the lower end of the inclined surface 146A is set such that the distal end of the transport screw 116 comes into contact with the lower end of the inclined surface 146A. Thus, when the distal end of the transport screw 116 (free end) is displaced upward due to the accumulated waste toner, the distal end comes into contact with the inclined surface 146A, and the transport screw 116 is bent.

The toner introduction portion 108 projecting in the −Z direction is provided on the far wall 142B, at the center in the X direction and at the upper end in the Y direction. Thus, when the transport pipe 120 is inserted into the toner introduction portion 108, the toner discharge port 120A and the introduction port 108A overlap in the Y direction, allowing the waste toner to be introduced from the transport pipe 120 to the waste-toner container 140.

The full-state detection sensor 130 is provided on the right wall 142E of the container body 142, to which the transport screw 116 is guided by the guide portion 143B, which is located at the highest position in the Y direction. The full-state detection sensor 130 is provided on the right wall 142E, at the center in the Z direction and at the upper part in the Y direction. FIG. 7A illustrates, with a dashed line T (G), the position of the upper surface of the waste toner T (or the developer G) when accumulated.

Operation

The operation according to the second exemplary embodiment will be described.

As illustrated in FIG. 7B, in the waste-toner container 140 according to the second exemplary embodiment, the first guide 143 and the second guide 144 guide the distal end (the other end) of the transport screw 116 in oblique directions intersecting the displacement direction (upward). Because this causes the waste toner T to be transported also in the width direction (the X direction and the −X direction) of the container body 142, the space inside the container body 142 not filled with the waste toner T is reduced compared with the configuration in which guides for the transport screw 116 are not provided.

In the waste-toner container 140, the full-state detection sensor 130 is provided on the right wall 142E, to which the transport screw 116 is eventually guided (by the guide portion 143B located at the highest position). Because this configuration allows the full-state detection sensor 130 to detect the height of the upper surface of the waste toner T that has been transported to the side to which the transport screw 116 is guided and that has accumulated to a high filling level, more waste toner T is recovered compared with the case where the full-state detection sensor 130 is provided at another position.

Furthermore, in the waste-toner container 140, the size of the first guide 143 and the second guide 144 in the Z direction is larger than the pitch of the spiral of the transport screw 116. Therefore, when the transport screw 116 is rotated, the first guide 143 or the second guide 144 does not enter the spaces between the spiral blades. Thus, malfunction of the transport screw 116 is prevented.

In addition, in the waste-toner container 140, the first guide 143 and the second guide 142 are provided by recessing portions of the container body 142 inward. This allows a user to place his or her fingers into these recesses to hold the container body 142, without providing separate members for allowing a user to hold the container body 142.

As illustrated in FIG. 7A, because the waste toner T (including the developer G) accumulates in a mound with the top being located at the center of the container body 142, the waste toner T accumulates less on the far wall 142B side of the introduction port 108A, leaving more empty space. Furthermore, in the waste-toner container 140, the first guide 143 and the second guide 144 are provided on the far wall 142B side with respect to the introduction port 108A. That is, in the waste-toner container 140, because the first guide 143 and the second guide 144 are provided in the empty space, the number of guides provided at a position where more waste toner T accumulates is reduced. Thus, decrease in capacity of the container body 142 due to the provision of the first guide 143 and the second guide 144 is suppressed.

Figure 8:
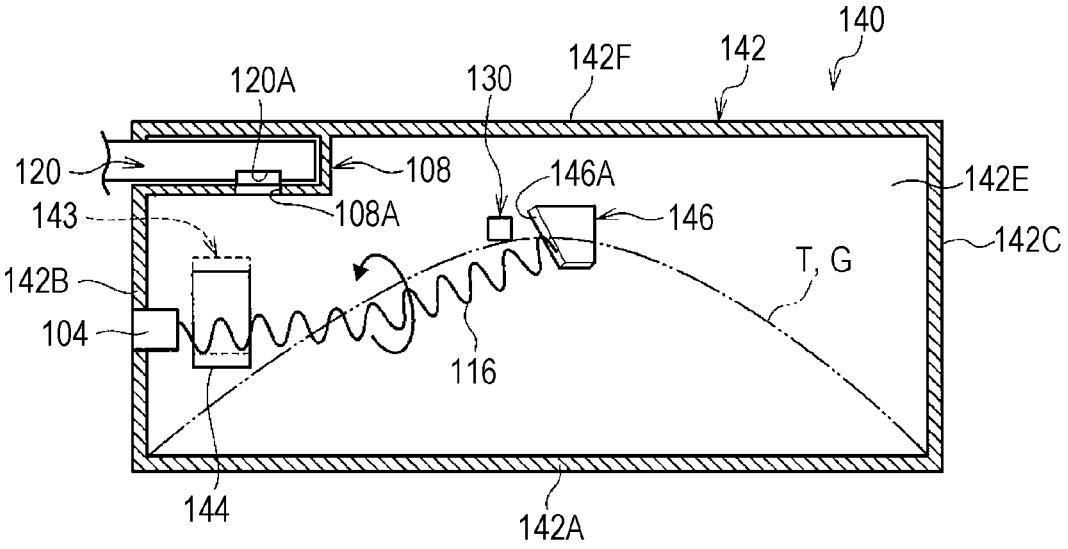
FIG. 8 illustrates the transport screw according to the second exemplary embodiment being bent by a screw guide.

Furthermore, as illustrated in FIG. 8, in the waste-toner container 140, when the amount of waste toner T accumulated in the container body 142 has increased, the distal end of the transport screw 116 comes into contact with the inclined surface 146A of the contact portion 146. Then, as the distal end of the transport screw 116 is displaced upward along the inclined surface 146A, the rotation axis (not illustrated) of the transport screw 116 is bent. As a result, not only the spiral portion, but also the entire transport screw 116 is eccentrically rotated. Thus, the waste toner T accumulated in a mound in the container body 142 comes into contact with the eccentric transport screw 116 and is broken and evened out.

Furthermore, in the image forming apparatus 10, when the full-state detection sensor 130 determines that the waste-toner container 140 is full and the waste-toner container 140 is replaced, the filling level of the waste-toner container 140 with the waste toner T is higher than that of the waste-toner container 200 according to the comparative example. Thus, the replacement frequency of the waste-toner container 140 is lower than that of the configuration in which the first guide 143 or the second guide 144 is not provided.

Note that the present invention is not limited to the above-described exemplary embodiments.

The number of guide portions (guides) is not limited to three, but may be two (provided so as to face each other in the X direction), four, or more. Furthermore, if the size of one guide portion in the Z direction is larger than the pitch of the spiral of the transport screw 116, guide portions may be provided in the Z direction.

The container bodies 102 and 142 do not necessarily have to be rectangular in the X-Y section (rectangular parallelepiped), but may be polygonal in the X-Y section.

The waste-toner containers 100 and 140 do not necessarily have to be attached from the front side of the image forming apparatus 10 (−Z direction side), but may be attached from one of the X direction side, the −X direction side, and the Z direction side.

The position where the transport screw 116 is supported (i.e., the position of the coupling portion 104), in a rotatable manner, on the far wall 102B is not limited to the center in the X direction and Y direction, but may be a position shifted in the X, −X, Y, or −Y direction from the center.

The contact portion 146 does not have to be provided in the waste-toner container 140.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder container comprising:

a container body for storing powder, the container body having an introduction port from which the powder is introduced;

a transport member having one end provided, in a rotatable manner, on a side wall of the container body, at a position below the introduction port, and the other end serving as a free end that is displaced upward as the amount of powder recovered in the container body increases, the transport member being configured to transport the powder from the one end to the other end by being rotated; and guide portions provided on the container body to guide the transport member in directions intersecting a direction in which the other end of the transport member is displaced as the transport member is displaced upward, wherein the transport member has a spiral shape, and wherein the size of the guide portions in a direction parallel to the axis of the transport member is larger than the pitch of the spiral of the transport member.

2. The powder container according to claim 1, wherein a detecting device that detects the powder in the container body is provided on a wall of the container body, to which the transport member is guided by the guide portion provided at the highest position.

3. The powder container according to claim 1, wherein the guide portions are provided at positions on the side wall side with respect to the introduction port.

4. The powder container according to claim 1, wherein the guide portions are provided by recessing portions of walls that are disposed in directions intersecting the side wall.

5. The powder container according to claim 1, wherein the container body has a contact portion that comes into contact with the transport member to bend the transport member.

6. An image forming apparatus comprising:

an image forming unit that transfers a toner image formed on an image bearing member for bearing a toner image to a recording medium to form an image;

a collecting unit that collects toner remaining on the image bearing member after the transfer of the toner image; and a toner container that is the powder container according to claim 1, into which the toner collected by the collecting unit is recovered through the introduction port.

* * * * *